US008849145B2

(12) United States Patent
Hashimoto et al.

(10) Patent No.: US 8,849,145 B2
(45) Date of Patent: Sep. 30, 2014

(54) IMAGE FORMING APPARATUS

(75) Inventors: Yoshinori Hashimoto, Susono (JP); Masato Hisano, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 70 days.

(21) Appl. No.: 13/324,761

(22) Filed: Dec. 13, 2011

(65) Prior Publication Data

US 2012/0155909 A1 Jun. 21, 2012

(30) Foreign Application Priority Data

Dec. 17, 2010 (JP) ..... 2010-282222
Dec. 17, 2010 (JP) ..... 2010-282223
Dec. 2, 2011 (JP) ..... 2011-264880

(51) Int. Cl.
*G03G 15/00* (2006.01)

(52) U.S. Cl.
CPC ..... *G03G 15/5016* (2013.01); *G03G 15/60* (2013.01)
USPC ..... 399/81

(58) Field of Classification Search
USPC ..... 399/81
See application file for complete search history.

(56) References Cited

U.S. PATENT DOCUMENTS

2002/0191980 A1* 12/2002 Kudo ..... 399/81
2006/0280516 A1* 12/2006 Combs et al. ..... 399/81
2010/0196041 A1* 8/2010 Otaki ..... 399/81

FOREIGN PATENT DOCUMENTS

JP 11-041390 A 2/1999
JP 2003-231328 A 8/2003
JP 2003-274071 A 9/2003
JP 2004-351679 A 12/2004
JP 2007-124461 A 5/2007
JP 2009-139880 A 6/2009
JP 2010-33042 A 12/2010

* cited by examiner

*Primary Examiner* — Clayton E Laballe
*Assistant Examiner* — Jas Sanghera
(74) *Attorney, Agent, or Firm* — Canon USA Inc IP Division

(57) ABSTRACT

An image forming apparatus includes a stack surface on which recording materials having images are stacked, the stack surface being provided on an upper surface of an apparatus body, and a movable unit shaped like a flat plate and provided on the upper surface of the apparatus body, the movable unit having a display portion configured to display information. At least a portion of the movable unit overlaps with the stack surface, as viewed in a vertical direction. A flat portion of the movable unit is movable between a first position along the upper surface of the apparatus body and a second position where a distance between the movable unit and the stack surface in the vertical direction is longer than at the first position.

27 Claims, 15 Drawing Sheets

IMAGE FORMING APPARATUS

BACKGROUND OF THE INVENTION

1. Field of the Invention

The present invention relates to an image forming apparatus including an operation unit whose angle and height are adjustable.

2. Description of the Related Art

An image forming apparatus of the related art is provided with an operation unit including buttons used to operate the apparatus and a display for displaying a state of the apparatus. The operation unit is located on an outer surface of the apparatus body.

In image forming apparatuses disclosed in Japanese Patent Laid-Open Nos. 2009-139880 and 2003-231328, the angle and height of the operation unit are adjustable so that operability and visibility can be freely changed according to usability of the user while keeping down the size of the apparatus during transport and storage.

SUMMARY OF THE INVENTION

One of the aspects of the disclosure is directed to an image forming apparatus comprising a stack surface on which recording materials having images are stacked, the stack surface being provided on an upper surface of an apparatus body and a movable unit shaped like a flat plate and provided on the upper surface of the apparatus body, the movable unit having a display portion configured to display information, wherein at least a portion of the movable unit overlaps with the stack surface, as viewed in a vertical direction, and wherein a flat portion of the movable unit is movable between a first position along the upper surface of the apparatus body and a second position, where a distance between the movable unit and the stack surface in the vertical direction is longer than at the first position.

Another aspects of the disclosure is directed to an image forming apparatus comprising a stack surface on which recording materials having images are stacked and a turnable movable unit having a display surface configured to display information, wherein at least a portion of the movable unit overlaps with the stack surface, as viewed in a vertical direction, wherein an angle of the display surface with respect to a horizontal direction is changed by turning the movable unit, and wherein a distance between the movable unit and the stack surface in the vertical direction increases as the angle of the display surface increases from about 0° to about 90°.

Another aspects of the disclosure is directed to an image forming apparatus comprising a stack surface on which recording materials having images are stacked, a movable unit having a display surface configured to display information, at least a portion of the movable unit overlapping with the stack surface, as viewed in a vertical direction, a detection device configured to detect that a number of sheets stacked on the stack surface has reached a predetermined number, and a control unit configured to stop an image forming operation on the basis of an output from the detection device, wherein the movable unit moves to change a distance between the movable unit and the stack surface in the vertical direction, and wherein the predetermined number is changed according to the distance between the movable unit and the stack surface in the vertical direction.

Further features of the present invention will become apparent from the following description of exemplary embodiments with reference to the attached drawings.

DESCRIPTION OF THE EMBODIMENTS

First Embodiment

Image Forming Apparatus

Figure 1A:
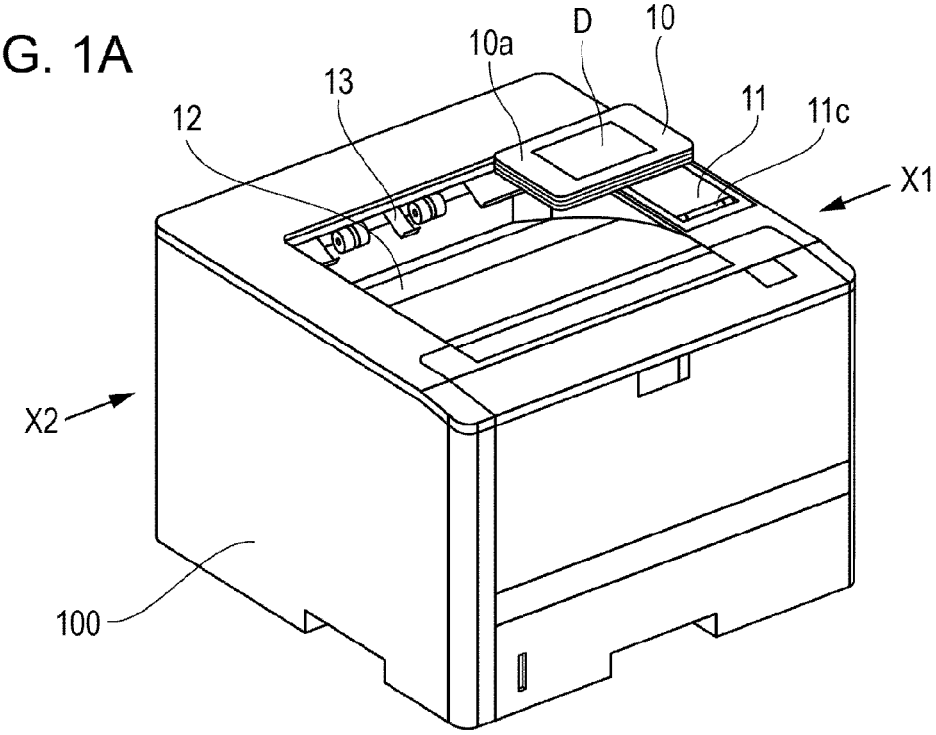
FIG. 1A is a perspective view of an image forming apparatus in which an operation unit is in a lying state.
Figure 1B:
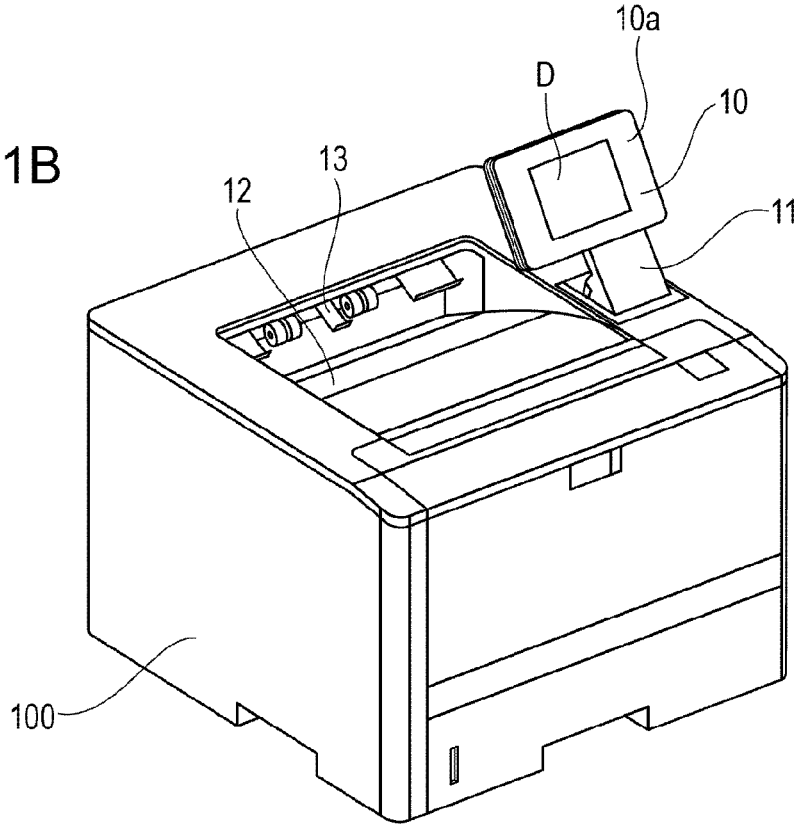
FIG. 1B is a perspective view of the image forming apparatus in which the operation unit is in a raised state.

First, an image forming apparatus 100 according to a first embodiment will be described with reference to FIGS. 1A and 1B. FIGS. 1A and 1B are perspective views illustrating, respectively, a state in which an operation unit 10 is in a lying state and a state in which the operation unit 10 is in a raised state. The operation unit 10 will be described below.

The image forming apparatus 100 of the first embodiment is an electrophotographic image forming apparatus. A main body of the image forming apparatus 100 contains a photosensitive drum, a charging device serving as a process unit that acts on the photosensitive drum, a scanner unit, a developing device, a transfer roller, a cleaner, and a fixing device. These components constitute an image forming section (not illustrated).

To form an image on a sheet serving as a recording material, a surface of the photosensitive drum is charged by the charging device while rotating the photosensitive drum, and the charged surface of the photosensitive drum is exposed by the scanner unit to form a latent image. The latent image is developed by the developing device to form a toner image on the surface of the photosensitive drum. Next, the toner image on the surface of the photosensitive drum is transferred onto a sheet conveyed to a transfer nip between the photosensitive drum and the transfer roller, and the sheet is conveyed to the fixing device and is heated and pressurized at a fixing nip, so that a fixed image is formed on the sheet. Toner that is not transferred onto the sheet at the transfer nip, but remains on the surface of the sensitive drum is removed by the cleaner. The sheet on which the fixed image is formed is output from above a stack surface 12 and is stacked on the stack surface 12. Such an operation of forming an image on the sheet and outputting the sheet onto the stack surface 12 is defined by an image forming operation.

While monochromatic image formation has been described above, image formation may be performed in a plurality of colors. Further, while the image forming apparatus 100 of the first embodiment is an electrophotographic image forming apparatus, it may be other apparatuses that form an image on a sheet by an inkjet method or by other means.

On an upper surface of the image forming apparatus 100, an operation unit (movable unit) 10 shaped like a flat plate is provided. The operation unit 10 has a flat portion 10*a* including a display serving as a display surface D for displaying information about the apparatus and a touch panel (operation surface) that the user touches to operate the apparatus. The touch panel (operation surface) of the first embodiment is provided on the display surface D. While the operation unit 10 of the first embodiment includes the display serving as a display portion, it may have only a display or only buttons or switches with which the user operates the apparatus. Further, the operation unit 10 may include a loading portion in which an external memory, such as a memory card, is loaded.

On the upper surface of the image forming apparatus 100, a stack surface 12 and a full-stack detection lever 13 are also provided. Sheets S are stacked on the stack surface 12. The full-stack detection lever 13 swings according to the quantity of sheets S stacked on the stack surface 12, and detects a full stack state of the sheets S. The full-stack detection lever 13 is pushed up and swung by the sheets S stacked on the stack surface 12. When the height of the stack of sheets S reaches a predetermined height, that is, when the full-stack detection lever 13 swings by a predetermined angle, it is determined that the sheets S are fully stacked, and an image forming operation is stopped. In this way, the image forming operation is stopped when the swing angle of the full-stack detection lever 13 exceeds a predetermined threshold value and the limit of the quantity of sheets S stacked on the stack surface 12 is set appropriately. This suppresses the occurrence of a jam.

While the operation unit 10 is mounted within an outline of the apparatus body 100 in the first embodiment, it hangs over the stack surface 12 because the image forming apparatus 100 is small. That is, at least a part of the operation unit 10 overlaps with the stack surface 12, as viewed in the vertical direction, and is located in a space (recording-material stack space) on the stack surface 12 where sheets S are to be stacked.

For this reason, when the operation unit 10 is in a lying state, as illustrated in FIG. 1A, a large height is not obtained between the stack surface 12 and a lower surface of the operation unit 10. In other words, the distance between the operation unit 10 and the stack surface 12 in the vertical direction is short in this state. Hence, if the image forming operation is continuously performed without removing stacked sheets S from the stack surface 12, the quantity of sheets S stacked on the stack surface 12 increases, and an output sheet S comes into contact with the operation unit 10. This may reduce stackability, for example, a jam occurs or an output sheet pushes out sheets that have been already stacked.

Position and Orientation Adjusting Mechanism for Operation Unit

Figure 2A:
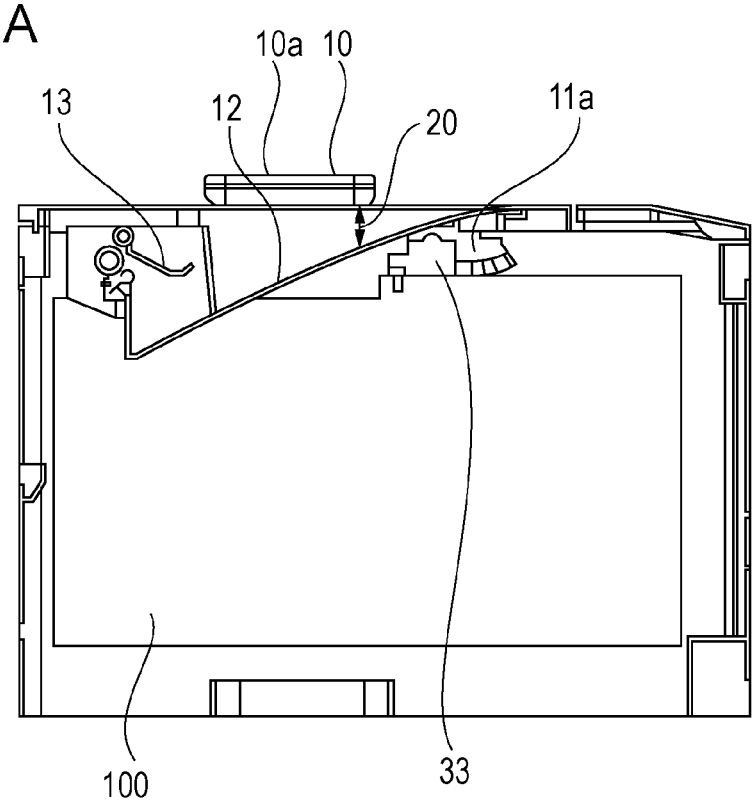
FIG. 2A is a cross-sectional view of the image forming apparatus in which the operation unit is in the lying state.
Figure 2B:
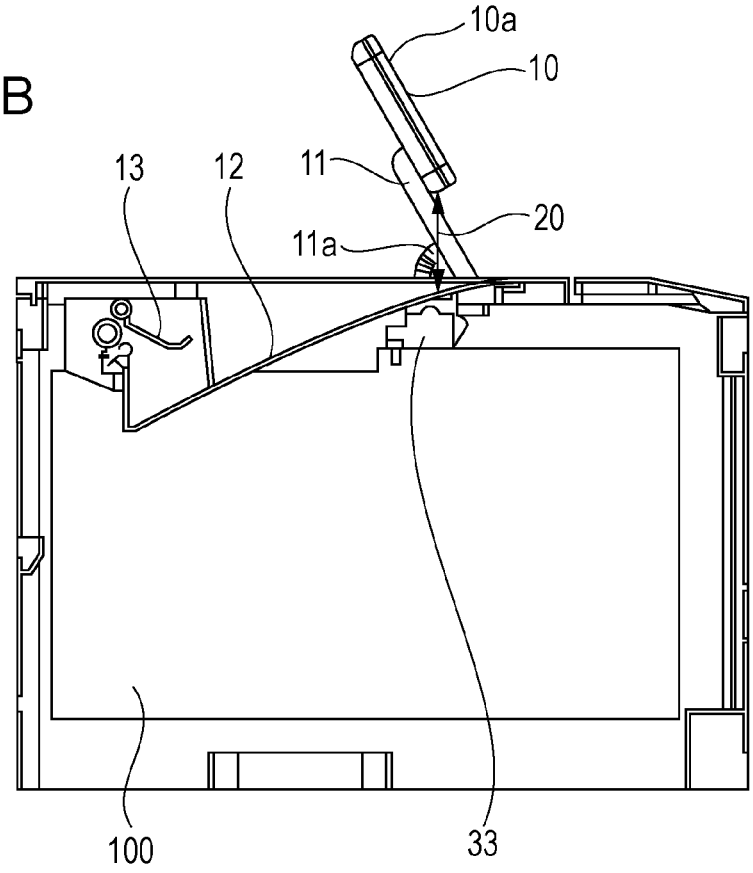
FIG. 2B is a cross-sectional view of the image forming apparatus in which the operation unit is in the raised state.
Figure 3A:
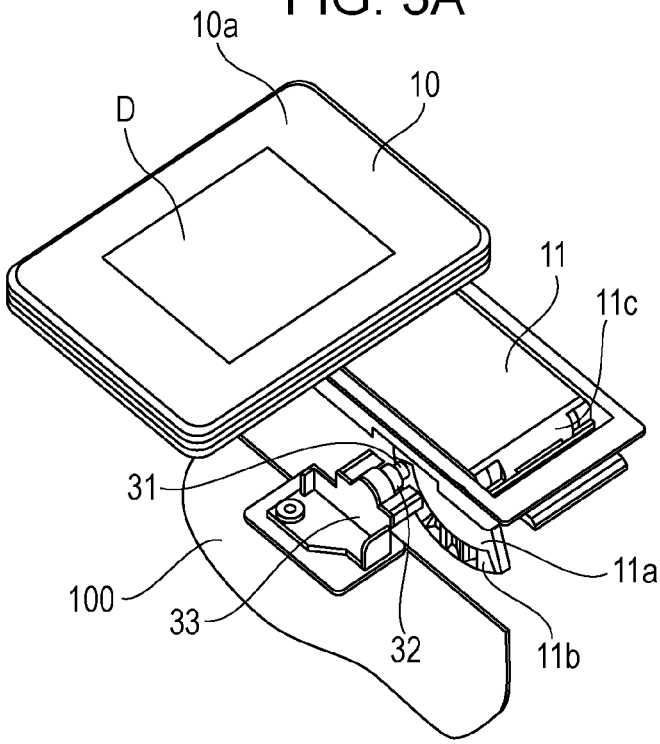
FIG. 3A is a perspective view of the operation unit in the lying state and its surroundings.
Figure 3B:
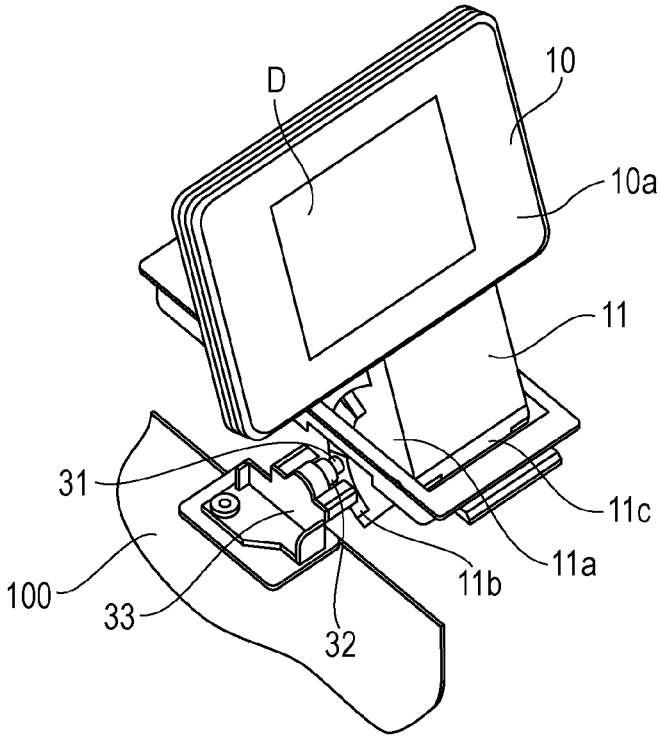
FIG. 3B is a perspective view of the operation unit in the raised state and its surroundings.

Accordingly, the image forming apparatus 100 of the first embodiment includes an adjusting mechanism for the operation unit 10 that adjusts the angle end height (position, orientation) of the operation unit 10. Next, this position and orientation adjusting mechanism will be described. FIG. 2A is a cross-sectional view of the image forming apparatus 100 in which the operation unit 10 is in a lying state. FIG. 2B is a cross-sectional view of the image forming apparatus 100 in which the operation unit 10 is in a raised state. FIG. 3A is a perspective view of the operation unit 10 in the lying state and its surroundings, and FIG. 3B is a perspective view of the operation unit 10 in the raised state and its surroundings. In FIGS. 3A and 3B, the interior of the outer casing of the apparatus body is seen through a part of the outer casing for easy explanation of the adjusting mechanism.

In the adjusting mechanism, the operation unit 10 is supported by an arm (arm member) 11 that couples the image forming apparatus body 100 and the operation unit 10. The arm 11 is supported by the apparatus body 100. The arm 11 turns on a turn center (turn shaft) 11*c* provided in the apparatus body 100 so as to change the angle and height of the operation unit 10.

The arm 11 that supports the operation unit 10 and couples the operation unit 10 and the apparatus body 100 includes a fan-shaped disk portion 11*a* provided integrally therewith, and a plurality of grooves 11*b* arranged in the circumferential direction of the disk portion 11*a* (circumferential direction centered on the turn shaft 11*c* of the arm 11).

The apparatus body 100 also includes an engaging pin 31 to engage with the grooves 11*b*, a compression spring 32 that biases the engaging pin 31 toward the turn shaft 11*c*, and a spring holder 33 that holds the engaging pin 31 and the compression spring 32. The engaging pin 31 is biased by the resilient force of the compression spring 32 so as to engage with the grooves 11*b* in a direction of the turn shaft 11*c*. In a state in which the engaging pin 31 is engaged with any of the grooves 11*b*, the arm 11 is held in that position. By changing the groove 11*b* with which the engaging pin 31 engages, the holding angle and height of the arm 11 can be changed.

Figure 4:
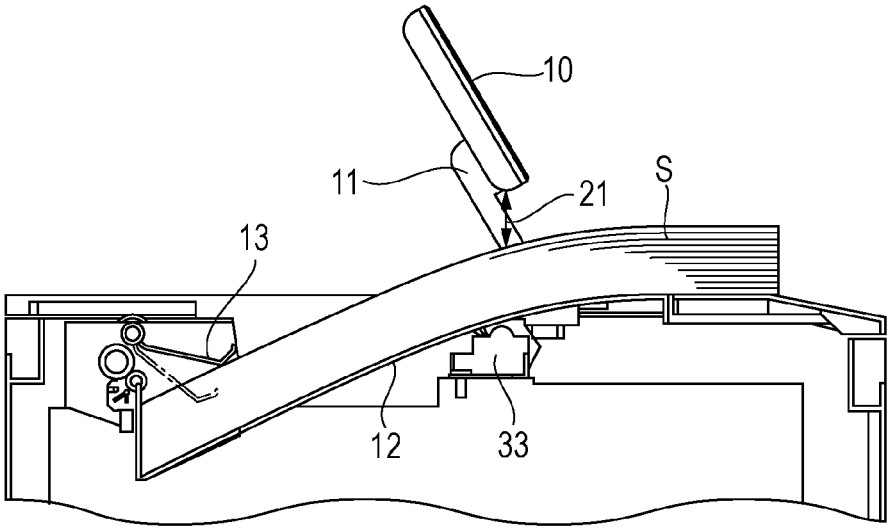
FIG. 4 is a partial sectional view of the image forming apparatus in which the operation unit is in the raised state.
Figure 5:
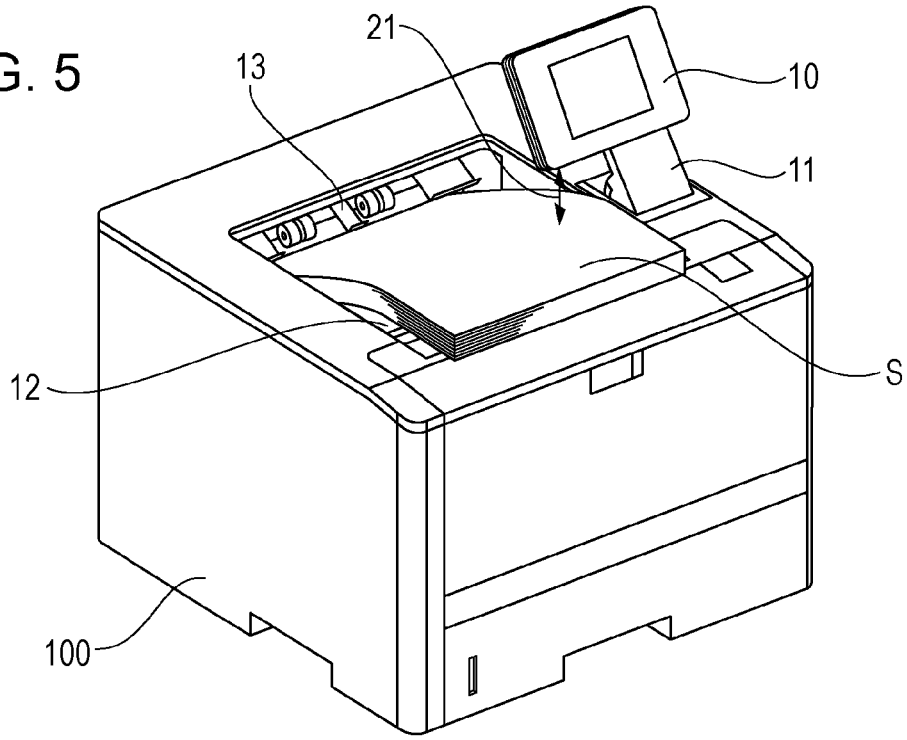
FIG. 5 is a perspective view of the image forming apparatus in which the operation unit is in the raised state.

Next, a description will be given of adjustment of the distance between the stack surface 12 and the operation unit 10 in the vertical direction. FIG. 4 is a partial sectional view of the image forming apparatus 100 in which the operation unit 10 is in a raised state. FIG. 5 is a perspective view of the image forming apparatus 100 in which the operation unit 10 is in the raised state.

In the first embodiment, when the operation unit 10 is moved from the lying state (FIG. 2A) to the raised state (FIGS. 2B, 4, 5) by the above-described adjusting mechanism, the distance between the operation unit 10 and the stack surface 12 in the vertical direction can increase. Therefore, a sufficient height 21 can be obtained between an output sheet S and the operation unit 10, and this prevents the output sheet S from coming into contact with the operation unit 10.

In this way, when the apparatus is not used, for example, during transport and storage, the arm 11 is tilted down (lies) and the flat portion 10*a* of the operation unit 10 is folded along the upper surface of the outer casing of the apparatus. This prevents the operation unit 10 from protruding from the outline of the apparatus, and realizes space saving (see FIGS. 1A and 2A). When the user raises the operation unit 10 from the lying state in order to use the apparatus, the distance between the stack surface 12 and the operation unit 10 in the vertical direction increases simultaneously. For this reason, during use of the apparatus, a sufficient distance 20 can be ensured between the stack surface 12 and the raised operation unit 10 in the vertical direction. Further, since the arm 11 can be held at a plurality of angles, the user can select the position and orientation of the operation unit 10 according to the user's preference. This enhances operability and visibility of the user.

In the first embodiment, as described above, the operation unit 10 is movable between the first position (lying state) where the flat portion 10*a* is laid along the upper surface of the apparatus body and the second position (raised state) where the distance 20 between the operation unit 10 and the stack surface 12 in the vertical direction is long. When the user raises the operation unit 10 (sets the operation unit 10 at the second position) during use of the apparatus body, the operation unit 10 can be moved away from the stack surface 12 in the vertical direction. For this reason, stackability of output sheets is not deteriorated.

As a general usage manner, it is conceivable for the user to use the image forming apparatus 100 on the desk. In such a manner, when the operation unit 10 is provided on the upper surface of the apparatus, the angle of the display surface D that provides good visibility of the user is 60° to 80° with respect to the angle of 0° (horizontal) of the display surface D in the lying state of the operation unit 10.

As the user raises the operation unit 10 (increases the angle of the display surface D from 0° toward 90°) during use of the image forming apparatus 100 in order to enhance operability or visibility, the distance 20 between the stack surface 12 and the operation unit 10 in the vertical direction increases. By virtue of this structure, the distance 20 between the stack surface 12 and the operation unit 10 in the vertical direction can be increased by utilizing the user's operation of raising the operation unit 10 to the angle that provides high visibility. This enhances usability.

Figure 6:
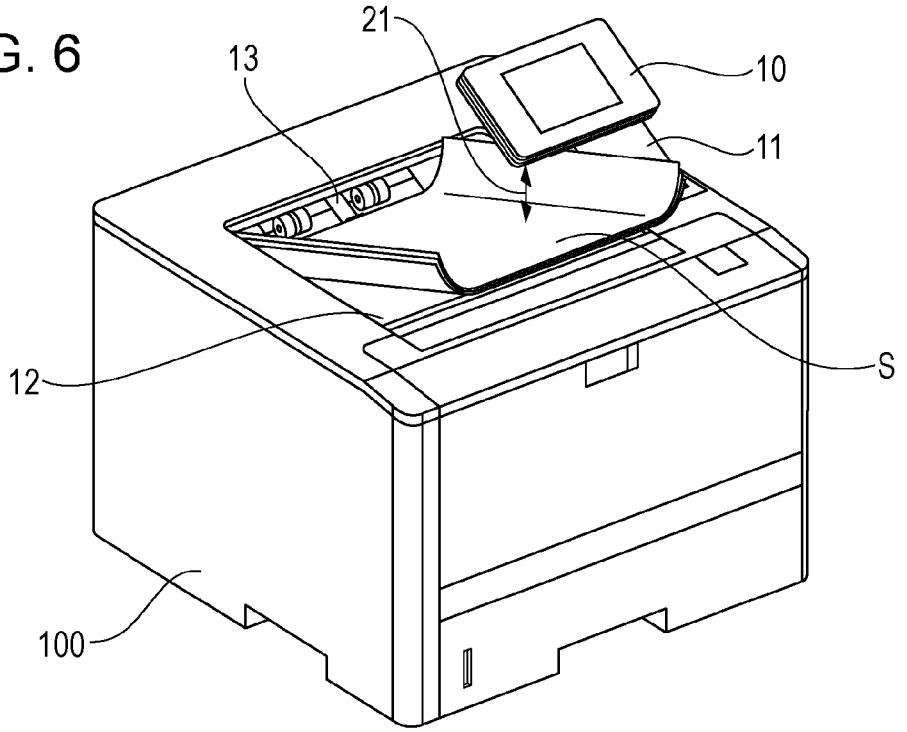
FIG. 6 is a perspective view of the image forming apparatus in which curled recording materials are output on a stack surface.

Next, a description will be given of a function of the operation unit 10 as a conveying guide on the stack surface 12 and a curl correction method. FIG. 6 is a perspective view of the image forming apparatus 100 in which curled sheets S are output on the stack surface 12. Since the operation unit 10 is located above the stack surface 12, it functions as a conveying guide for the sheets S output on the stack surface 12 according to the setting angle and height thereof. For example, when a sheet S curled at an end is output, as illustrated in FIG. 6, the curled end of the sheet S is conveyed along the lower side of the operation unit 10, and therefore, the operation unit 10 can assist in stable conveyance. In the structure of the related art illustrated in FIGS. 14A and 14B, since no conveying guide is provided above the stack surface 12, it is difficult to assist in conveyance of an output sheet S, and the sheet S is placed at a free position on the stack surface 12. In contrast, in the structure of the first embodiment illustrated in FIG. 6, since the operation unit 10 guides an output sheet S, sheet alignment on the stack surface 12 can be improved. As the angle of the operation unit 10 in the conveying direction of the sheet S decreases, the sheet S becomes less likely to be caught by the operation unit 10. This assists in conveyance.

The operation unit 10 also has a curl correcting function for sheets S stacked on the stack surface 12 according to the setting angle and height thereof. When a sheet S heated by the fixing device (not illustrated) is curled by being cooled on the stack surface 12, an end of the sheet S is pressed from above by the operation unit 10, thereby suppressing the growth of a curl. In the structure of the related art illustrated in FIGS. 14A and 14B, since there is no sheet pressing member, a curls of the end of the sheet S grows with cooling. In contrast, in the structure of the first embodiment illustrated in FIG. 6, since the output sheet S is pressed from above by the operation unit 10, a curl of the sheet S can be suppressed and corrected. In this case, only the end of the curled sheet S comes into contact with the operation unit 10, and a height 21 between the sheet S and the operation unit 10 is ensured in a portion other than the end. For this reason, the output sheet S is prevented from being caught by the operation unit 10, and stackability is not deteriorated. This contributes to improvement in conveyance performance and stackability of easy-to-curl sheets such as thin paper or left paper.

In this way, in the first embodiment, the operation unit is movable relative to the apparatus body and the distance between the operation unit and the stack surface in the vertical direction can be changed by moving the operation unit. Hence, a sufficient quantity of sheets stacked on the stack surface can be ensured in the image forming apparatus in which at least a part of the operation unit is located in the space above the stack surface where the sheets are to be stacked.

In the first embodiment, as the surface of the operation unit is raised from the lying state, the distance between the operation unit and the stack surface in the vertical direction increases. For this reason, the distance therebetween can be increased by utilizing the user's operation of raising the operation unit for use. This enhances usability.

Second Embodiment

Next, a second embodiment will be described. Components similar to those adopted in the first embodiment are denoted by the same reference numerals, and descriptions thereof will be skipped.

Association Between Position and Orientation Adjustment of Operation Unit 10 and Full-Stack Detection Next, a description will be given of a structure characteristic of the second embodiment, that is, a structure in which the turn angle of the operation unit 10 and a threshold value of the swing angle of the full-stack detection lever 13, which detects a full-stack state of sheets S stacked on the stack surface 12, change in association with each other.

Figure 7A:
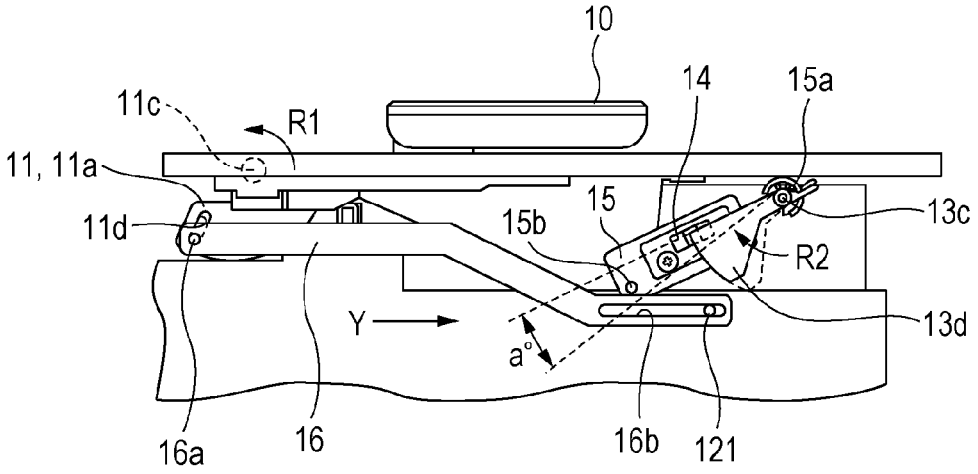
FIG. 7A is a partial sectional view of the image forming apparatus in which the operation unit is in the lying state, as viewed in an X1-direction in FIG. 1A.
Figure 7B:
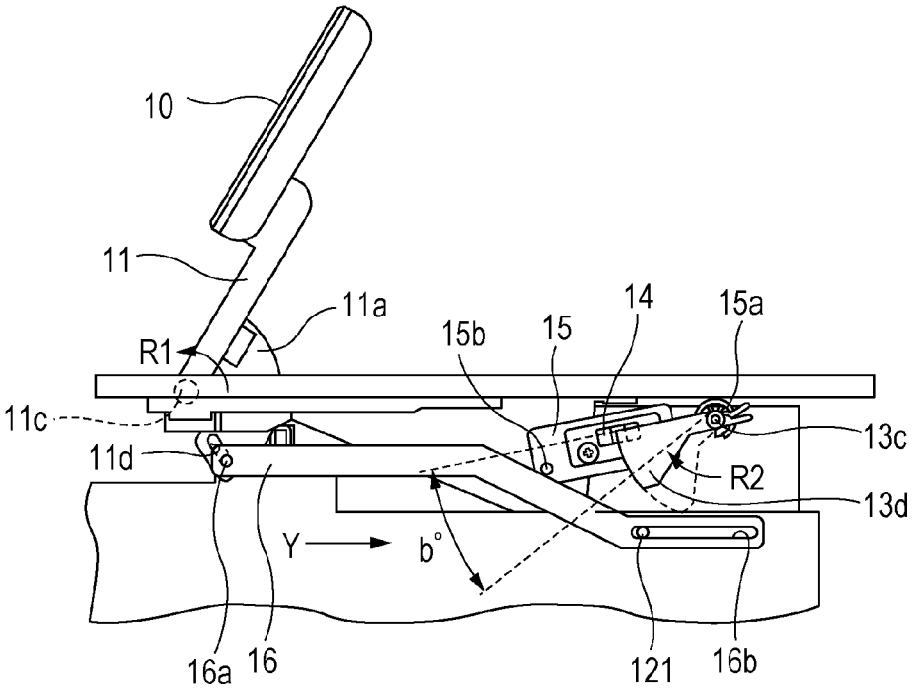
FIG. 7B is a partial sectional view of the image forming apparatus in which the operation unit is in the raised state, as viewed in the X1-direction in FIG. 1A.
Figure 8A:
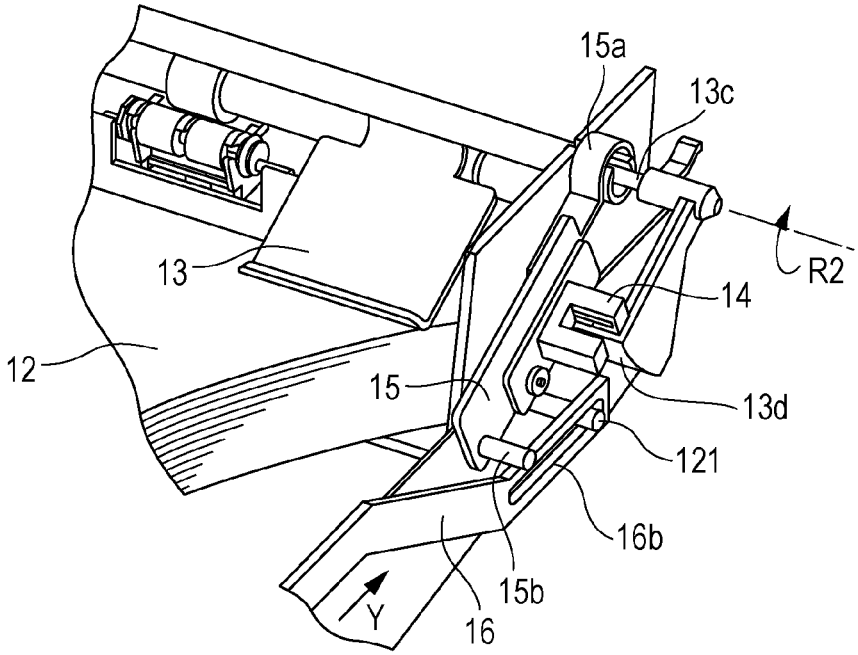
FIG. 8A is a perspective view of a full-stack detection lever and its surroundings in the image forming apparatus in which the operation unit is in the lying state.
Figure 8B:
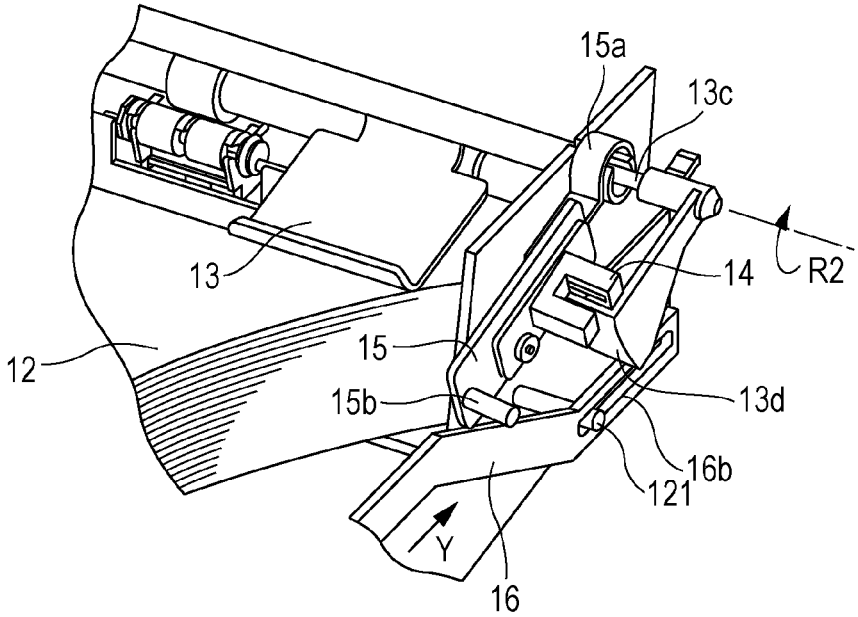
FIG. 8B is a perspective view of the full-stack detection lever and its surroundings in the image forming apparatus in which the operation unit is in the raised state.

FIGS. 7A and 7B are partial sectional views of an image forming apparatus 100, as viewed in an X1-direction of FIG. 1A. FIG. 7A illustrates a state in which an operation unit 10 is in a lying state, and FIG. 7B illustrates a state in which the operation unit 10 is in a raised state. FIGS. 8A and 8B are perspective views of the full-stack detection lever 13 and its surroundings. FIG. 8A illustrates a state in which the operation unit 10 is in the lying state, and FIG. 8 illustrates a state in which the operation unit 10 is in the raised state. In FIGS. 8A and 8B, for convenience, the interior of the image forming apparatus 100 is illustrated without showing a part of an outer casing of the image forming apparatus 100.

First, a description will be given of a full-stack detection mechanism serving as a full-stack detection device of the second embodiment.

The full-stack detection lever 13 swings on a swing shaft 13*c*. The swing shaft 13*c* is provided with a flag portion 13*d* that blocks light in a photosensor 14, and the flag portion 13*d* swings on the swing shaft 13*c* together with the full-stack detection lever 13. The photosensor 14 is formed by a photo-interrupter including a light emitting portion (not illustrated) and a light receiving portion that receives light from the light emitting portion. When light emitted from the light emitting portion toward the light receiving portion is blocked by the flag portion 13*d*, the photosensor 14 detects that the flag portion 13*d* comes between the light emitting portion and the light receiving portion, and outputs a signal. For this reason, as sheets S are stacked on the stack surface 12, the stacked sheets S push the full-stack detection lever 13 upward, and simultaneously, the flag portion 13*d* moves upward. When the stacked sheets S push up the full-stack detection lever 13 and the flag portion 13*d* reaches a predetermined position to block light in the photosensor 14, the photosensor 14 detects that the light receiving portion becomes unable to receive light from the light emitting portion, and outputs a signal.

Figure 16:
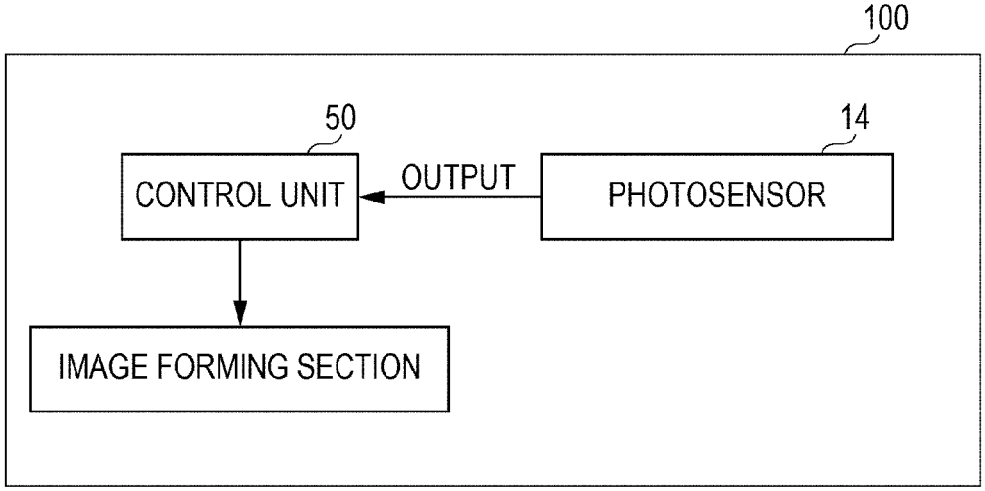
FIG. 16 schematically illustrates a control configuration of an image forming section.

FIG. 16 illustrates a schematic control configuration for an image forming section in the image forming apparatus 100. As illustrated in FIG. 16, a signal output from the photosensor 14 is transmitted to a control unit 50 that controls an image forming operation of the image forming section. On the basis of the signal output from the photosensor 14, the control unit 50 determines that the quantity of sheets S stacked on the stack surface 12 reaches a predetermined quantity, and stops the image forming operation of the image forming section.

Next, a description will be given of a structure for associating the full-stack detection device with position and orientation adjustment of the operation unit 10.

The photosensor 14 is integrally supported by a photosensor support member 15. The photosensor support member 15 can swing on the swing shaft 13*c* with a fitting portion 15*a* being fitted on the swing shaft 13*c*. The photosensor support member 15 also has a boss 15*b* to contact with a link member 16.

As illustrated in FIGS. 7A and 7B, a shaft 16*a* provided at one end of the link member 16 is rotatably fitted in a slot 11*d* provided in a fan-shaped disk portion 11*a* of an arm 11. The slot 11*d* is long in a radial direction of a turn shaft 11*c*. The other end of the link member 16 has a slot 16*b* in which a shaft 121 of the apparatus body 100 is fitted slidably. The link member 16 can move in the Y-direction along a guide (not illustrated). This structure allows the full-stack detection device to associate with the position and orientation adjustment of the operation unit 10.

Next, a specific description will be given of a case in which the operation unit 10 is turned upward from a lying state.

When the operation unit 10 is turned and raised upward (R1-direction) on the turn shaft 11*c* from a state of FIGS. 7A and 8A, the link member 16 moves in the Y-direction. The boss 15*b* of the photosensor support member 15 is pushed up by the link member 16 that moves in the Y-direction, so that the photosensor support member 15 swings upward (R2-direction) on the swing shaft 13*c*, and the photosensor 14 also swings upward (R2-direction).

When the operation unit 10 is thus raised from the lying state, the photosensor 14 swings upward according to the raising angle. Hence, a position where the flag portion 13*d* can block light in the photosensor 14 moves upward (R2-direction). For this reason, light in the photosensor 14 cannot be blocked by the flag portion 13*d* unless the number of sheets S to be stacked is increased to increase the swing amount of the full-stack detection lever 13 as the raising amount of the operation unit 10 increases. In other words, the upper limit of the quantity of sheets S stacked on the stack surface 12 set in the image forming apparatus 100 continuously increases as the operation unit 10 is raised upward.

Figure 9A:
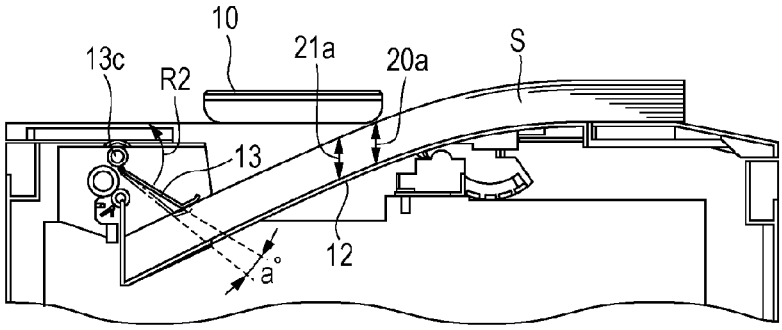
FIG. 9A is a partial sectional view of the image forming apparatus in which the operation unit is in the lying state, as viewed in an X2-direction in FIG. 1A.
Figure 9B:
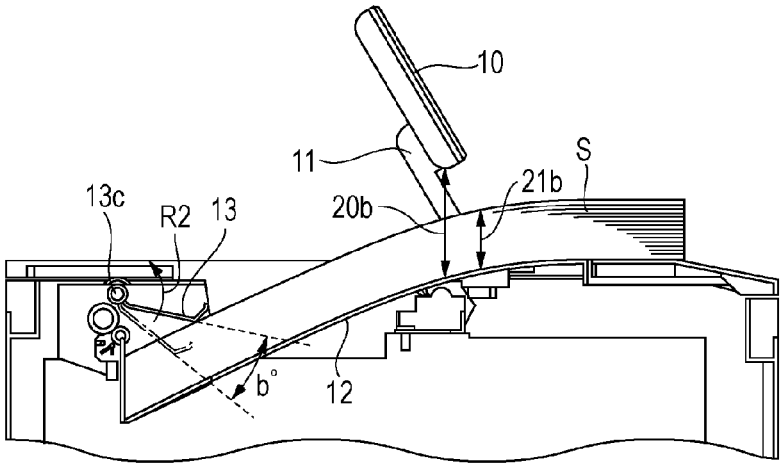
FIG. 9B is a partial sectional view of the image forming apparatus in which the operation unit is maximally raised, as viewed in the X2-direction in FIG. 1A.

Next, a specific description will be given of a structure in which the upper limit of the quantity of sheets S stacked on the stack surface 12 differs according to the raising amount of the operation unit 10. FIGS. 9A and 9B are partial sectional views of the image forming apparatus 100, as viewed in an X2-direction of FIG. 1A. FIG. 9A illustrates a state in which the operation unit 10 is in a lying state, and FIG. 9B illustrates a state in which the operation unit 10 is raised maximally.

In a case in which the operation unit 10 is in a lying state, when the full-stack detection lever 13 swings a° upward (R2-direction) from a state in which it is not pushed up by sheets S (an initial state shown by a broken line), as illustrated in FIGS. 7A and 9A, the flag portion 13*d* of the full-stack detection lever 13 blocks light in the photosensor 14, whereby a full-stack state of the sheets S is detected, and an image forming operation is stopped.

In contrast, in a case in which the operation unit 10 is maximally raised, as illustrated in FIGS. 7B and 9B, when the full-stack detection lever 13 swings b° upward (R2-direction) from a state in which it is not pushed up by the sheets S, the flag portion 13*d* of the full-stack detection lever 13 blocks light in the photosensor 14, whereby a full-stack state of the sheets S is detected, and an image forming operation is stopped.

Therefore, in the lying state of the operation unit 10, sheets S can be stacked on the stack surface 12 to a height 21*a*. Here, the height 21*a* is smaller than a distance 20*a* between a lower surface of the operation unit 10 in the lying state and the stack surface 12 in the vertical direction. This can prevent an output sheet S from being caught and jammed by the operation unit 10.

In the state in which the operation unit 10 is maximally raised, sheets S can be stacked on the stack surface 12 to a height 21*b* (21*b*>21*a*). Here, the height 21*b* is smaller than a distance 20*b* between the lower surface of the maximally raised operation unit 10 and the stack surface 12 in the vertical direction (20*b*>20*a*). This can prevent an output sheet S from being caught and jammed by the operation unit 10.

In this way, in the second embodiment, as the operation unit 10 is raised from the lying state, the distance between the lower surface of the operation unit 10 and the stack surface 12 in the vertical direction increases from the distance 20*a* to the distance 20*b*, and the quantity of sheets S that can be stacked on the stack surface 12 increases. In the second embodiment, as the operation unit 10 is raised from the lying state, the photosensor 14 moves upward. Hence, the amount by which the flag portion 13*d* should be moved to block light in the photosensor 14 increases (a threshold value of the swing angle of the full-stack detection lever 13 increases). That is, when the operation unit 10 is raised, the upper limit of the height of a stack of sheets S on the stack surface 12 (a quantity of sheets S stacked on the stack surface 12 that allows detection of a full-stack state) is greatly changed from the height 21*a* to the height 21*b*.

For this reason, compared with a case in which the upper limit of the quantity of sheets S stacked on the stack surface 12 that allows detection of a full-stack state is constantly set at a value (21*a*) such that the operation unit 10 in the lying state and the sheets S do not touch, regardless of the raising amount of the operation unit 10, the upper limit of the quantity of sheets S stacked on the stack surface 12 increases as the raising amount of the operation unit 10 increases in the second embodiment. This allows more sheets S to be stacked.

While the photosensor 14 is adopted in the second embodiment, any other detection member that can detect the position of the full-stack detection lever 13 may be used. Further, while the photosensor 14 is moved by the link member 16 in the second embodiment, an actuator may be provided to move the photosensor 14 in association with the raising motion of the operation unit 10.

In this way, in the second embodiment, as the raising amount of the operation unit 10 increases, the number of sheets S that can be stacked on the stack surface 12 increases. As a result, a more quantity of sheets S stacked on the stack surface 12 can be ensured.

Third Embodiment

Next, a third embodiment will be described. Components similar to those adopted in the second embodiment are denoted by the same reference numerals, and descriptions thereof will be skipped. Only points different from those of the second embodiment will be described.

The third embodiment is different from the second embodiment in that a turn angle of an operation unit 10 and a threshold value of a swing angle of a full-stack detection lever 13, which detects a full-stack state of sheets S stacked on a stack surface 12, change in association with each other. That is, while the photosensor 14 moves upward as the operation unit 10 is raised in the second embodiment, the threshold value of the swing angle of the full-stack detection lever 13 is changed by changing the position of a flag portion 13*d* provided integrally with the full-stack detection lever 13 in the third embodiment.

Figure 10A:
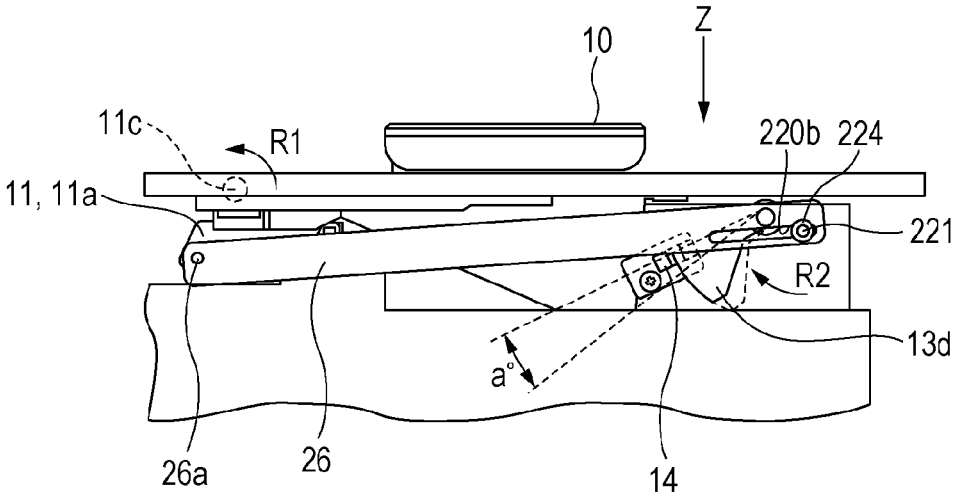
FIG. 10A is a partial sectional view of the image forming apparatus in which the operation unit is in the lying state, as viewed in the X1-direction in FIG. 1A.
Figure 10B:
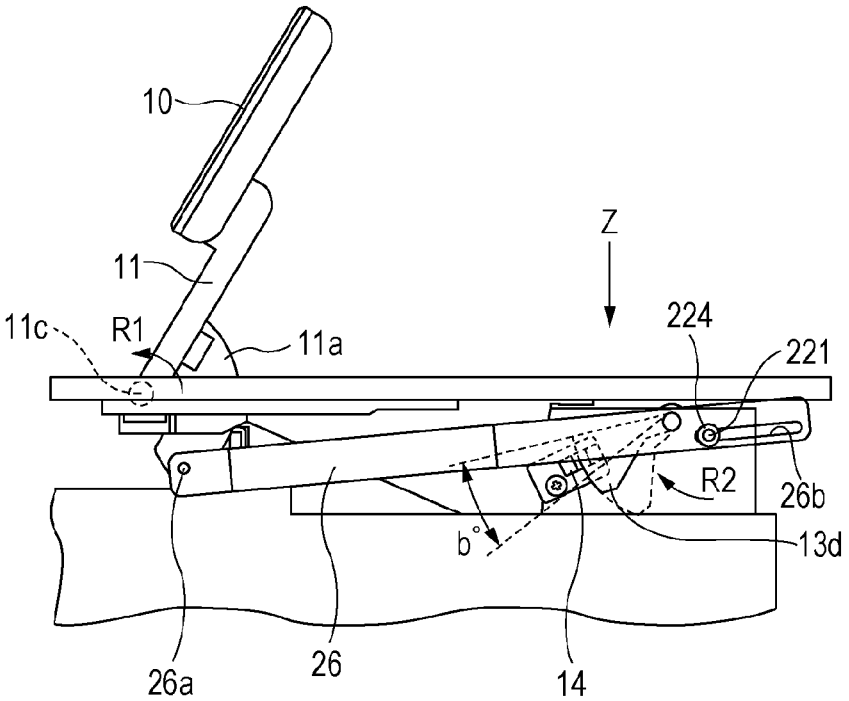
FIG. 10B is a partial sectional view of the image forming apparatus in which the operation unit is in the raised state, as viewed in the X1-direction in FIG. 1A.
Figure 11A:
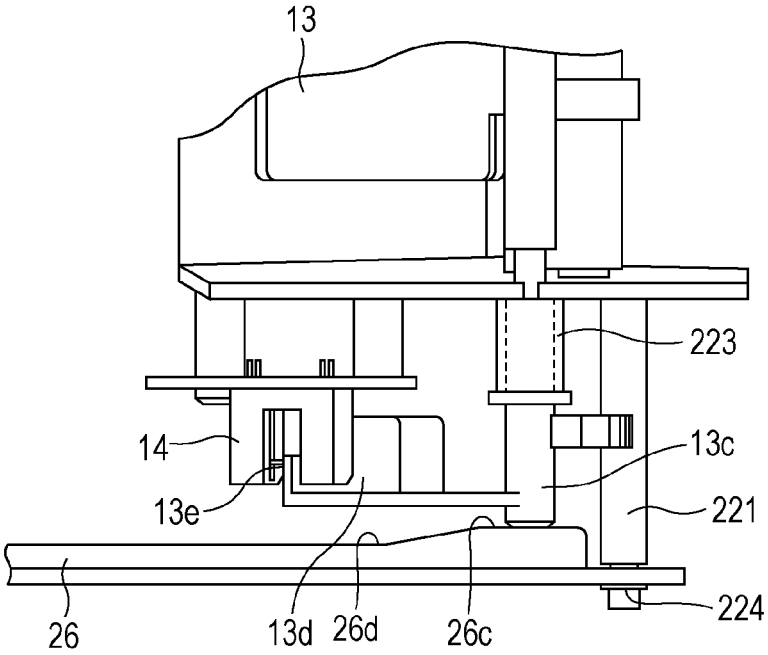
FIG. 11A illustrates the full-stack detection lever and its surroundings in a state in which the operation unit is in the lying state, as viewed in a Z-direction in FIG. 10A.
Figure 11B:
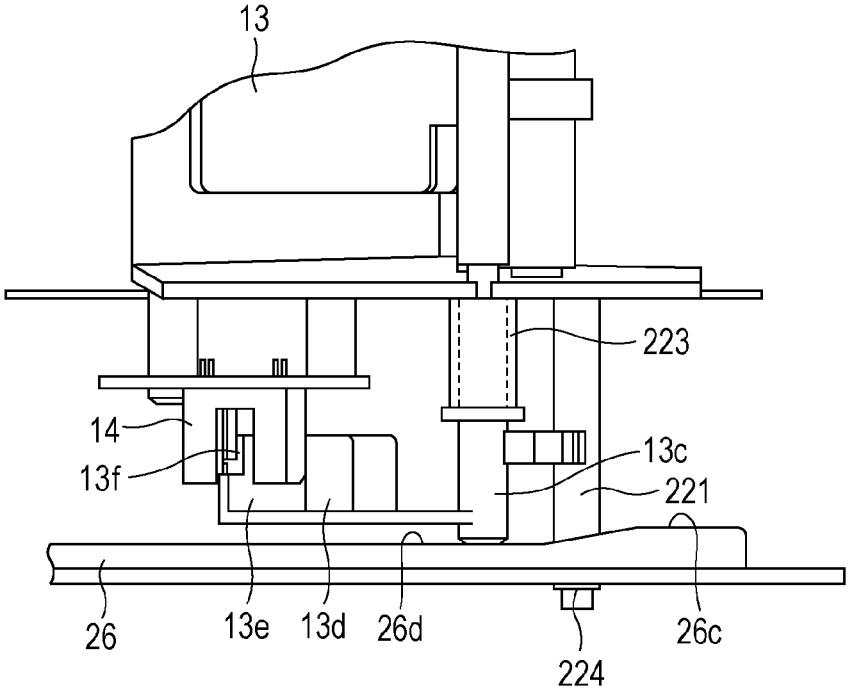
FIG. 11B illustrates the full-stack detection lever and its surroundings in a state in which the operation is in the raised state, as viewed in the Z-direction in FIG. 10B.

FIGS. 10A and 10B are partial sectional views of an image forming apparatus 100, as viewed in the X1-direction of FIG. 1A. FIG. 10A illustrates a lying state of the operation unit 10, and FIG. 10B illustrates a raised state of the operation unit 10. FIGS. 11A and 11B illustrates a full-stack detection lever 13 and its surroundings, as viewed in a Z-direction of FIGS. 10A and 10B. FIG. 11A illustrates a lying state of the operation unit 10, and FIG. 11B illustrates a raised state of the operation unit 10.

In the third embodiment, a photosensor 14 is fixed to an apparatus body 100. A shaft 26*a* provided at one end of a link member 26 is rotatably fitted in a fan-shaped disk portion 11*a* of an arm 11 (FIGS. 10A and 10B). The other end of the link member 26 has a slot 26*b*, in which a shaft 221 of the apparatus body 100 is slidably fitted. The position of the slot 26*b* in an axial direction of the shaft 221 is determined by a stopper 224 (FIGS. 10A and 10B). A thickness of the other end of the link member 26 in a direction of a swing shaft 13*c* (hereinafter referred to as an axial direction) continuously decreases toward the left in FIGS. 11A and 11B. That is, the other end of the link member 26 includes a thick portion 26*c* and a thin portion 26*d* (FIGS. 11A and 11B). The positions of the full-stack detection lever 13, the swing shaft 13*c*, and the flag portion 13*d* in the axial direction are determined by the swing shaft 13*c* being pressed against the link member 26 by a compression spring 223.

Next, a description will be given of the motion the flag portion 13*d* makes when the operation unit 10 is turned upward from a lying state.

In a lying state of the operation unit 10 (FIGS. 10A and 11A), the position of the flag portion 13*d* in the axial direction is determined by contact between the swing shaft 13*c* and the thick portion 26*c* of the link member 26. When the operation unit 10 is turned and raised upward (R1-direction) on a turn shaft 11*c* from this state, the link member 26 supported by the disk portion 11*a* and the shaft 221 moves to the right in the figures. Then, the thickness of a portion of the link member 26 in contact with the swing shaft 13*c* continuously decreases. In a state in which the operation unit 10 is maximally raised (FIGS. 10B and 11B), the position of the flag portion 13*d* in the axial direction is determined by contact between the swing shaft 13*c* and the thin portion 26*d* of the link member 26.

Figure 12A:
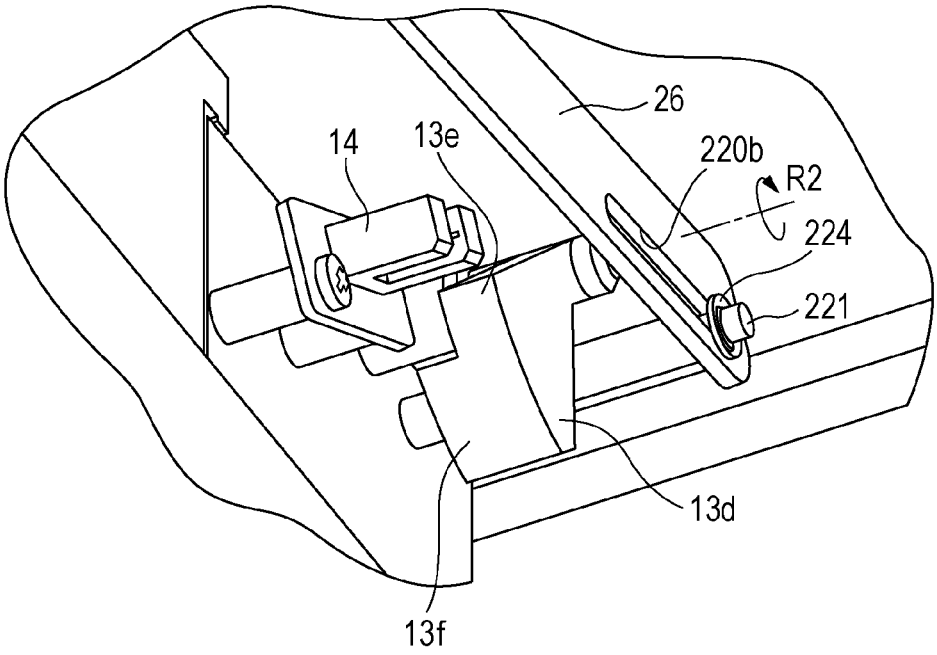
FIG. 12A is a perspective view of the full-stack detection lever and its surroundings in the image forming apparatus in which the operation unit is in the lying state and light is not blocked in a photosensor.
Figure 12B:
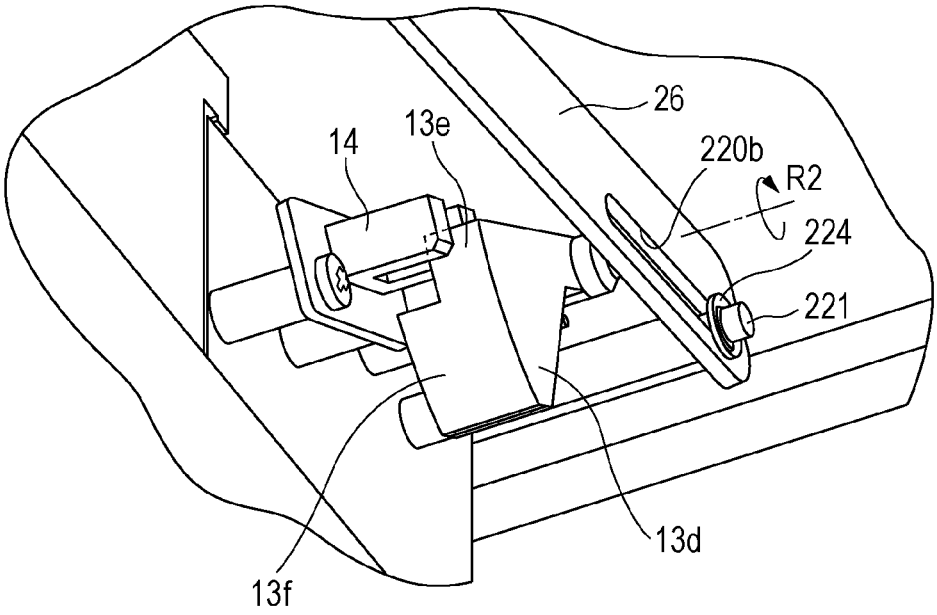
FIG. 12B is a perspective view of the full-stack detection lever in the image forming apparatus in which the operation unit is in the lying state and light is blocked in the photosensor.

Next, a description will be given of a full-stack detecting operation performed by the full-stack detection lever 13 in a lying state of the operation unit 10. FIGS. 12A and 12B are perspective views of the full-stack detection lever 13 and its surroundings in the apparatus in which the operation unit 10 is in a lying state. FIG. 12A illustrates a state in which light is not blocked in the photosensor 14, and FIG. 12B illustrates a state in which light is blocked in the photosensor 14. The flag portion 13*d* has a first light blocking portion 13*e* that is narrow in the axial direction and a second light blocking portion 13*f* that is wide in the axial direction. These two light blocking portions are arranged in a step form so that the first light blocking portion 13*e* is located at a position higher (R2-direction) than the second light blocking portion 13*d*.

In the lying state of the operation unit 10, the position of the flag portion 13*d* in the axial direction is determined by the thick portion 26*c* of the link member 26. For this reason, when the full-stack detection lever 13 is pushed up (R2-direction) by sheets S stacked on the stack surface 12, light in the photosensor 14 is blocked by the first light blocking portion 13*e* (FIG. 12B), so that a full-stack state is detected and an image forming operation is stopped.

Figure 13A:
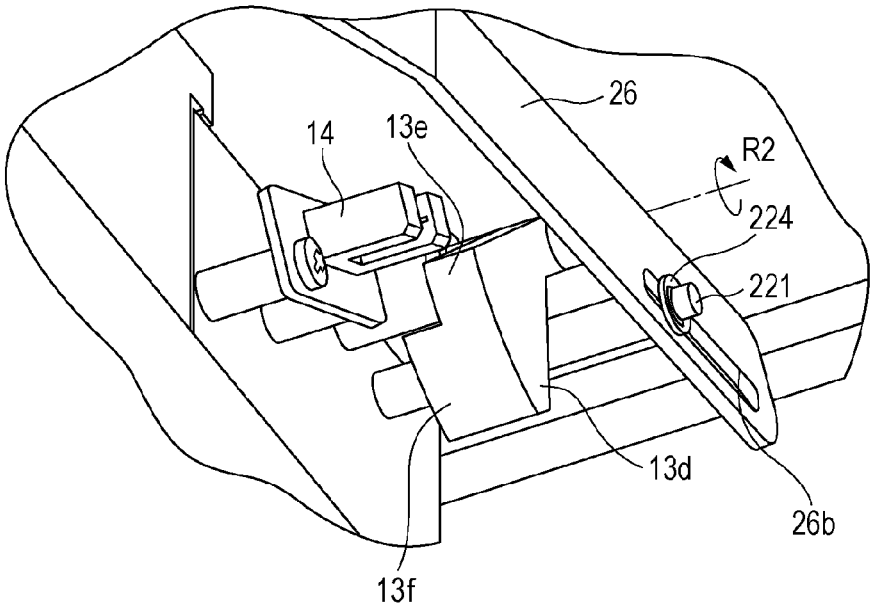
FIG. 13A is a perspective view of the full-stack detection lever and its surroundings in the image forming apparatus in which the operation unit is in the raised state and light is not blocked in the photosensor.
Figure 13B:
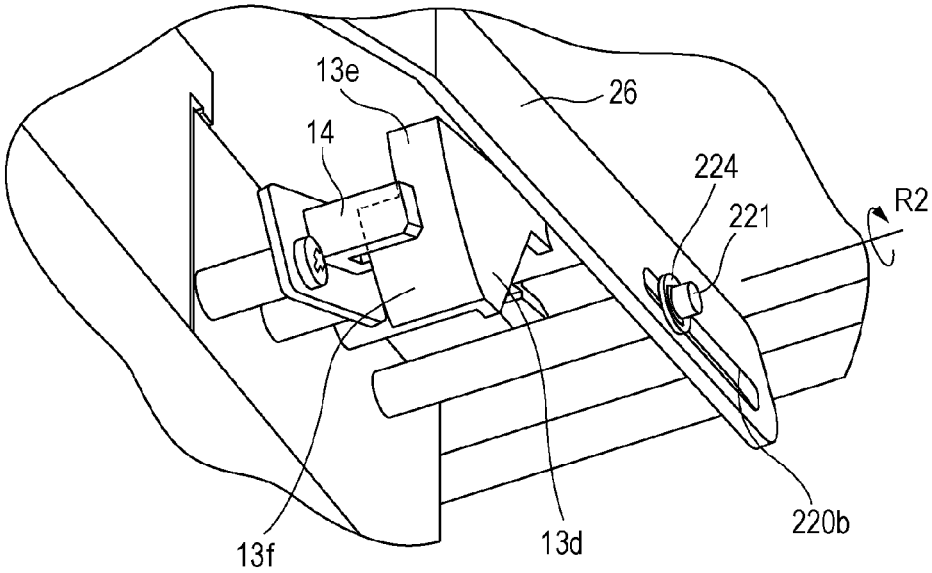
FIG. 13B is a perspective view of the full-stack detection lever in the image forming apparatus in which the operation unit is in the raised state and light is blocked in the photosensor.

Next, a description will be given of full-stack detection performed by the full-stack detection lever 13 in a state in which the operation unit 10 is raised maximally. FIGS. 13A and 13B are perspective views of the full-stack detection lever 13 and its surroundings in the apparatus in the maximally raised state of the operation unit 10. FIG. 13A illustrates a state in which light is not blocked in the photosensor 14, and FIG. 13B illustrates a state in which light is blocked in the photosensor 14.

In the state in which the operation unit 10 is maximally raised, the position of the flag portion 13*d* in the axial direction is determined by the thin portion 26*d* of the link member 26. For this reason, when the full-stack detection lever 13 is pushed upward (R2-direction) by sheets S stacked on the stack surface 12, light in the photosensor 14 is blocked by the second light blocking portion 13*f* (FIG. 13B), so that a full-stack state is detected and an image forming operation is stopped. When the flag portion 13*d* is displaced in the axial direction, the first light blocking portion 13*e* is displaced relative to the photosensor 14 in the axial direction. Hence, even when the first light blocking portion 13*e* overlaps with the photosensor 14 in the R2-direction, it does not block light in the photosensor 14.

Comparing a case in which the first light blocking portion 13*e* blocks light in the photosensor 14 and a case in which the second light blocking portion 13*f* blocks light in the photosensor 14, the former case is better because the angle by which the full-stack detection lever 13 is swung upward is smaller. That is, the quantity of sheets S stacked on the stack surface 12 that allows detection of a full-stack state is smaller in the lying state of the operation unit 10. The position of the first light blocking portion 13*e* in the R2-direction is set such that the height of the stack of sheets S from which a full-stack state is detected is equivalent to the height 21*a* in the first embodiment. For this reason, it is possible to prevent an output sheet S from being caught and jammed by the operation unit 10 in the lying state.

The position of the second light blocking portion 13*f* in the R2-direction is set such that the height of the stack of sheets S from which a full-stack state is detected is larger than the height 21*a* and smaller than or equal to the height 21*b*.

For this reason, compared with a case in which the upper limit of the number of sheets S from which a full-stack state is detected is constantly set at the value (21*a*) such that the operation unit 10 in the lying state does not touch the stacked sheets S, regardless of the raising amount of the operation unit 10, more sheets S can be stacked in the third embodiment because the upper limit of the quantity of sheets S stacked on the stack surface 12 increases as the operation unit 10 is raised.

In this way, in the third embodiment, the stack number is increased by raising the operation unit 10.

In the third embodiment, the light blocking portions that are different in width in the axial direction like the first light blocking portion 13*e* and the second light blocking portion 13*f* are arranged in a stepped form so as to change the position of the flag portion 13*d* in the axial direction. This provides two different times at which light is blocked in the photosensor 14. However, the light blocking portions are not limited to this form. That is, the number of light blocking portions may be increased. Alternatively, the flag portion 13*d* may have a light blocking portion whose width in the axial direction continuously increases in the R2-direction. In this case, as the operation unit 10 is raised, the upper limit of the number of sheets S stacked on the stack surface 12 (the quantity of sheets S stacked on the stack surface 12 from which a full-stack state is detected) increases continuously. This allows the quantity of sheets S stacked on the stack surface 12 to increase as the operation unit 10 is raised.

An actuator may be provided to change the position of the flag portion 13*d* in the axial direction in association with the raising motion of the operation unit 10.

In this way, in the third embodiment, the moving amount (swing amount) by which the flag portion 13*d* should move to reach the predetermined position to block light in the photosensor 14 is increased by moving the flag portion 13*d* in association with the operation unit 10. Hence, similarly to the first embodiment, the number of sheets that can be stacked on the stack surface 12 increases as the operation unit 10 is raised. This ensures a larger quantity of sheets S stacked on the stack surface 12.

Figure 14A:
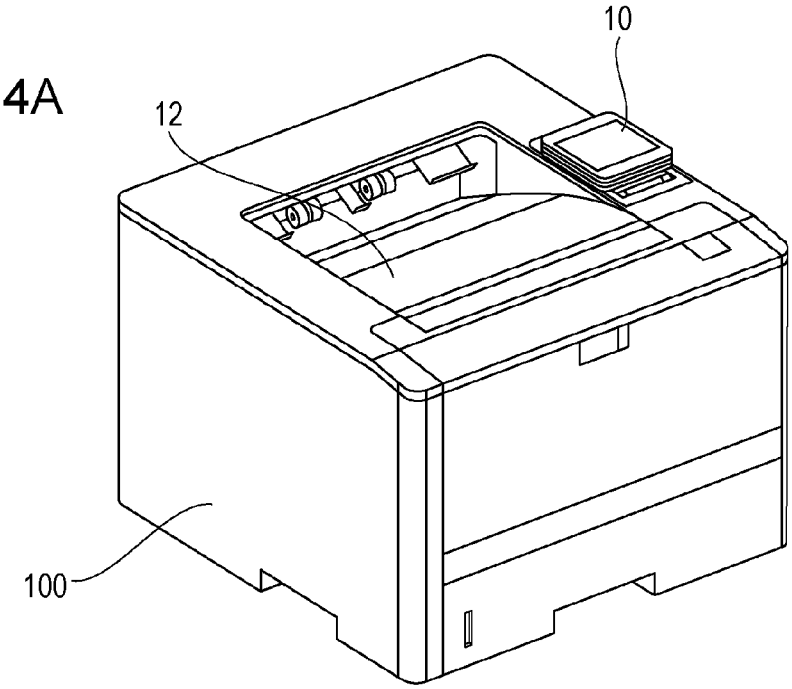
FIGS. 14A and 14B are perspective views of an image forming apparatus of the related art.
Figure 14B:
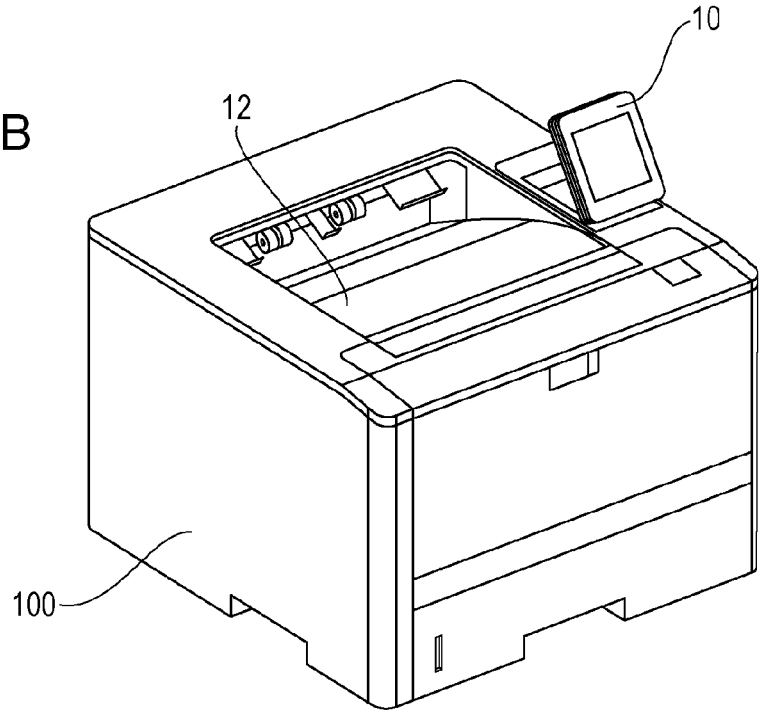

As described above, from the viewpoint of usability, an operation unit is often provided at a position such as to be easily operated from the upper and front sides of an apparatus body 100. FIGS. 14A and 14B illustrate such an image forming apparatus of the related art. An image forming apparatus body 100 includes an operation unit 10. Similarly, from the viewpoint of usability, a stack surface 12 on which sheets are to be output after image formation is often provided at a position such as to be easily accessed from the upper and front sides of the apparatus body 100. For this reason, the operation unit 10 and the stack surface 12 are often located close to each other.

In particular, there is a recent tendency to increase the size of the operation unit because the size of the display has increased with the increase in amount of information to be displayed on the display, for example, a print preview of data read from an external memory. On the other hand, the size of the apparatus body tends to be reduced further.

Figure 15:
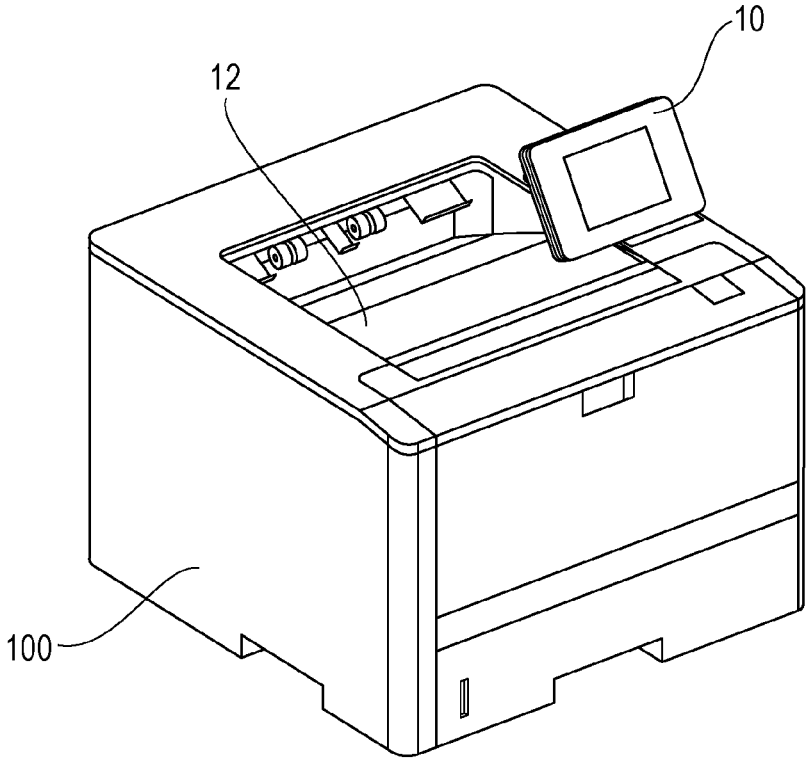
FIG. 15 is a perspective view illustrating the arrangement of an operation unit and a stack surface.

For this reason, it is difficult to secure a place for the operation unit. As illustrated in FIG. 15, the operation unit is sometimes unavoidably provided at a position to protrude in a space above a near stack surface in which sheets are to be stacked.

However, when the operation unit thus protrudes in the space above the stack surface for sheets, the distance between the stack surface and the operation unit in the vertical direction is limited. For this reason, the number of sheets that can be stacked on the stack surface (the upper limit of the quantity of sheets stacked on the stack surface) is reduced.

The present embodiment provides an image forming apparatus in which at least a part of an operation unit is located in a space above a stack surface where sheets are to be stacked and in which a sufficient quantity of sheets stacked on the stack surface can be ensured.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-282222 filed Dec. 17, 2010, No. 2010-282223 filed Dec. 17, 2010, and No. 2011-264880 filed Dec. 2, 2011, which are hereby incorporated by reference herein in their entirety.

What is claimed is:

1. An image forming apparatus comprising:

a stack surface on which recording materials having images are stacked, the stack surface being provided on an upper surface of an apparatus body; and a movable unit having a flat plate shape and provided on the upper surface of the apparatus body and above the stack surface, the movable unit having a display surface configured to display information, wherein at least a portion of the movable unit overlaps with the stack surface, as viewed in a vertical direction, wherein the movable unit is movable between a first position, where the display surface is disposed along the upper surface of the apparatus body and a second position, where an angle formed by the display surface with respect to the vertical direction is smaller than when the display surface is disposed at the first position, and wherein a distance between a lower edge of the portion of the movable unit and the stack surface in the vertical direction is longer when the movable unit is disposed at the second position than when the movable unit is disposed at the first position.

2. The image forming apparatus according to claim 1, wherein the movable unit moves between the first position and the second position by rotating relative to the apparatus body.

3. The image forming apparatus according to claim 1, further comprising:

a detection device configured to detect that a number of sheets stacked on the stack surface has reached a predetermined number; and a control unit configured to stop an image forming operation based on an output from the detection device, wherein the predetermined number is changed according to a position of the movable unit.

4. The image forming apparatus according to claim 1, wherein the movable unit includes an operating portion to be operated by a user.

5. The image forming apparatus according to claim 2;

wherein an angle of the display surface with respect to a horizontal direction is changed by rotating the movable unit, and wherein a distance between the lower edge of the movable unit and the stack surface in the vertical direction increases as the angle of the display surface increases from about 0° toward about 90°.

6. The image forming apparatus according to claim 2, further comprising:

an arm configured to couple the movable unit with the apparatus body, wherein the movable unit is moved from the first position to the second position by rotating the arm with respect to the apparatus body.

7. The image forming apparatus according to claim 2, wherein a rotation shaft around which the movable unit is rotated is disposed lower than the movable unit when the movable unit is at the second position.

8. An image forming apparatus comprising:

a stack surface on which recording materials having images are stacked;

a movable unit having a display surface configured to display information, at least a portion of the movable unit overlapping with the stack surface, as viewed in a vertical direction;

a detection device configured to detect that a number of sheets stacked on the stack surface has reached a predetermined number; and a control unit configured to stop an image forming operation on the basis of an output from the detection device, wherein the movable unit moves to change a distance between the movable unit and the stack surface in the vertical direction, and wherein the predetermined number is changed according to the distance between the movable unit and the stack surface in the vertical direction.

9. The image forming apparatus according to claim 8, wherein the movable unit changes the distance between the movable unit and the stack surface in the vertical direction by rotating relative to an apparatus body.

10. The image forming apparatus according to claim 8, wherein the movable unit includes an operating portion to be operated by a user.

11. The image forming apparatus according to claim 7 wherein the rotation shaft around which the movable unit is rotated is perpendicular to a direction in which recording materials are discharged from the apparatus body.

12. An image forming apparatus comprising:

a stack surface on which recording materials having images are stacked, the stack surface being provided on an upper surface of an apparatus body; and a movable unit having a flat plate shape and provided on the upper surface of the apparatus body, the movable unit having a display portion configured to display information;

a detection device configured to detect that a number of sheets stacked on the stack surface has reached a predetermined number; and a control unit configured to stop an image forming operation based on an output from the detection device, wherein the predetermined number is changed according to a position of the movable unit, wherein at least a portion of the movable unit overlaps with the stack surface, as viewed in a vertical direction, and wherein a flat portion of the movable unit is movable between a first position along the upper surface of the apparatus body and a second position, where a distance between the portion of the movable unit and the stack surface in the vertical direction is longer than at the first position.

13. The image forming apparatus according to claim 1, wherein a distance between an upper edge of the movable unit and the stack surface in the vertical direction is longer when the movable unit is disposed at the second position than when the movable unit is disposed at the first position.

14. The image forming apparatus according to claim 1, wherein the display surface of the movable unit is in contact with the upper surface of the apparatus when the movable unit is disposed at the first position.

15. The image forming apparatus according to claim 12, wherein the movable unit moves between the first position and the second position by turning relative to the apparatus body.

16. The image forming apparatus according to claim 12, wherein the movable unit includes an operating portion to be operated by a user.

17. An image forming apparatus comprising:

a stack surface on which recording materials having images are stacked; and a turnable movable unit having a display surface configured to display information;

a detection device configured to detect that a number of sheets stacked on the stack surface has reached a predetermined number; and a control unit configured to stop an image forming operation on the basis of an output from the detection device, wherein the predetermined number is changed according to a position of the movable unit, wherein at least a portion of the movable unit overlaps with the stack surface, as viewed in a vertical direction, wherein an angle of the display surface with respect to a horizontal direction is changed by turning the movable unit, and wherein a distance between the movable unit and the stack surface in the vertical direction increases as the angle of the display surface increases from about 0° to about 90°.

18. The image forming apparatus according to claim 17, wherein the movable unit includes an operating portion to be operated by a user.

19. The image forming apparatus according to claim 1, wherein the image forming apparatus forms an image on the recording material by transferring a toner image formed on a photosensitive drum to the recording material and discharges the recording material on which the image is formed to the stack surface.

20. The image forming apparatus according to claim 19, wherein the image forming apparatus forms an image in a plurality of colors on the recording material.

21. The image forming apparatus according to claim 19, wherein the movable unit comprises a touch panel for operating the apparatus.

22. The image forming apparatus according to claim 19 further comprising;

a contacting member which is movable and being in contact with the recording material stacked on the stack surface.

23. The image forming apparatus according to claim 19, wherein the movable unit moves between the first position and the second position by rotating relative to the apparatus body, wherein the stack surface is inclined with respect to a horizontal direction, and wherein a rotation shaft around which the movable unit rotates is parallel to the stack surface.

24. The image forming apparatus according to claim 21 further comprising;

a contacting member which is movable and being in contact with the recording material stacked on the stack surface.

25. The image forming apparatus according to claim 21, wherein the movable unit moves between the first position and the second position by rotating relative to the apparatus body, wherein the stack surface is inclined with respect to a horizontal direction, and wherein a rotation shaft around which the movable unit rotates is parallel to the stack surface.

26. The image forming apparatus according to claim 22, wherein the movable unit moves between the first position and the second position by rotating relative to the apparatus body, wherein the stack surface is inclined with respect to a horizontal direction, and wherein a rotation shaft around which the movable unit rotates is parallel to the stack surface.

27. The image forming apparatus according to claim 1, wherein the image forming apparatus forms an image on the recording material and discharges the recording material on which the image is formed to the stack surface.

* * * * *